United States Patent [19]

McGough

[11] Patent Number: 5,038,908

[45] Date of Patent: Aug. 13, 1991

[54] SELF-LOCKING COIN RECEPTACLE COVER

[75] Inventor: Gerald M. McGough, Huntsville, Ala.

[73] Assignee: Quadrum Telecommunications Inc.

[21] Appl. No.: 484,892

[22] Filed: Feb. 26, 1990

[51] Int. Cl.[5] ..... G07F 9/06

[52] U.S. Cl. ..... 194/350; 232/15

[58] Field of Search ..... 194/350, 351; 232/15, 232/16; 109/45, 46, 66

[56] References Cited

U.S. PATENT DOCUMENTS

| | | | |
|---|---|---|---|
| 2,052,322 | 8/1936 | Terry | 232/15 |
| 2,096,476 | 10/1937 | Veale | 232/15 |
| 3,016,185 | 1/1962 | Osborne | 232/15 |
| 3,428,216 | 2/1969 | Bolen | 194/351 X |
| 3,837,566 | 9/1974 | McGrough | 232/15 |

*Primary Examiner*—David A. Bucci
*Assistant Examiner*—Craig Slavin

[57] ABSTRACT

A self-locking coin receptacle cover for use in telephone paystation. A rotating shutter is controlled by a draw bar to lock into an open position automatically in response to insertion into a paystation, and automatically locks into a closed position in response to removal. Reset is accomplished manually.

6 Claims, 3 Drawing Sheets

SELF-LOCKING COIN RECEPTACLE COVER

BACKGROUND OF THE INVENTION

1. Field of the Invention

The present invention pertains to coin telephones and more particularly to a self-locking coin receptacle cover for use in coin telephones.

2. Background Art

The presently used self-locking coin receptacle covers as found in telephone paystations, i.e., coin telephones manufactured by AT&T, GTE and Palco Telecom Inc., as well as others have utilized essentially the same configuration and design for many years. Such a unit is shown in my U.S. Pat. No. 3,837,566 which issued on Sept. 24, 1974.

In most of these units, when the coin receptacle, or vault unit as it is known, is inserted into the coin telephone, a shutter is forced into an open position. In this position coins deposited in the phone may be deposited in the vault. When the coin vault is inserted into the coin telephone, a release latch is also activated. This release latch then permits a second latch to activate when the shutter is forced to its close position upon removal of the coin receptacle or vault. In this manner, the second latch functions to lock the shutter closed over the opening to the coin receptacle. Reset then is typically accomplished by breaking the seal of the coin receptacle, opening the receptacle, then collecting the coins found therein, and subsequently rewinding with a screwdriver the second latch to its home position. The receptacle is then closed and resealed. Obviously, a disadvantage of existing designs is the inclusion of an over abundance of costly parts which are exceedingly difficult to assemble. Because of the high cost, manufacturers of coin telephones have been forced, in order to remain competitive, to utilize off-shore sources for coin receptacle covers, which, however, are frequently inferior in design and construction. Accordingly, it is the intent of the present invention to provide a new and more economical coin receptacle cover which is sturdy, utilizes a minimum number of parts, and provides for easy assembly during the manufacturing process.

SUMMARY OF THE INVENTION

The present invention includes a shutter which is riveted to an associated cover and which rotates to open and close the coin vault or receptacle lid opening. The shutter is typically biased to its closed position by a torsion spring which bears on a pin included in the shutter mechanism. Upon rotation, the same pin which is riveted to the shutter operates to push a draw bar by engaging the end of a slot included in that draw bar. The draw bar, in turn, is biased toward an extension spring mounting pin. When the shutter is fully open, another pin also projecting through the draw bar falls into another slot located in the draw bar. This operation prevents the draw bar from returning to its original set position when the shutter returns to its home position.

When the shutter returns to the home position, the first pin will move along the draw bar slot so that when the shutter is in the home position the draw bar rotates slightly engaging a different leg of that slot with that first identified pin. Thus, in this position, the shutter remains locked.

To reset the mechanism from the locked position, a small screwdriver or similar tool is guided through a channel of the cover over the door mechanism to a set position. By this action, the draw bar is raised out of its locked position with the pins being realigned into the included slots and moved back into the set position.

DESCRIPTION OF THE PREFERRED EMBODIMENT

Figure 1:
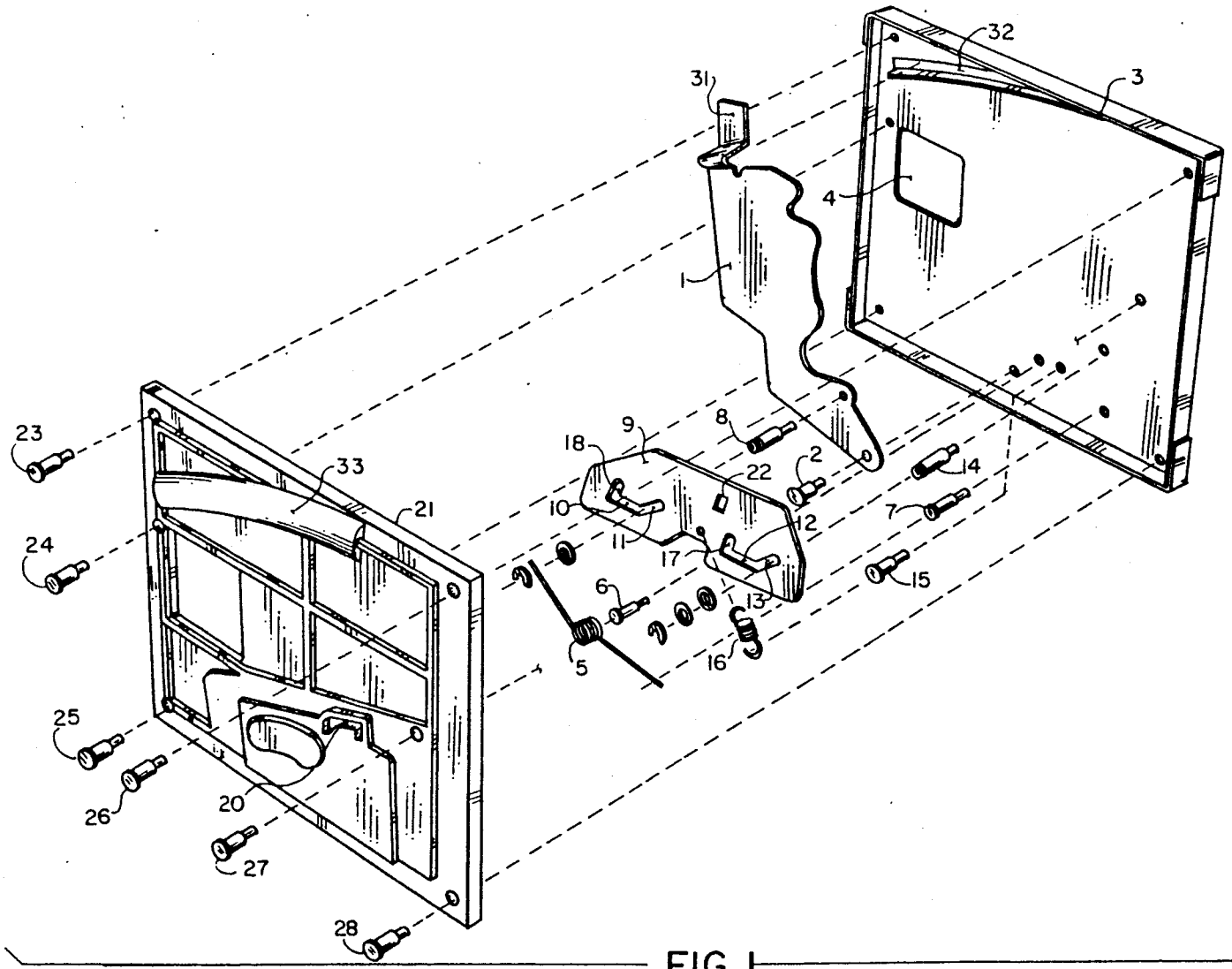
FIG. 1 is an exploded view of a self-locking coin receptacle cover in accordance with the present invention.

Referring now to FIG. 1, an exploded view of a self-locking coin receptacle cover in accordance with the present invention is shown. The cover consists of base 3 to which is mounted shutter 1 by means of pin 2. It should be noted that the shutter is free to rotate, however, about pin 2. Also secured to shutter 1 is pin 8 which is positioned within slot 10 of draw bar 9. Secured to base 3 is pin 14 which engages slot 12 of draw bar 9. Operation of the shutter is effectively controlled by the biasing of torsion spring 5 which is mounted with its center point at pin 6 one end at pin 7, with the other end of the spring bearing on pin 8 which projects through slot 10 of the draw bar as mentioned previously. Draw bar 9 is normally biased toward extension spring mounting pin 15 which is riveted to base 3, biasing taking place by means of extension spring 16 secured to an opening in the center of draw bar 9.

Slots 10 and 12 include extension portions to facilitate movement of the draw bar which consist of legs 11 and 18 on slot 10 and legs 13 and 17 on slot 12. It should be noted also that a projection 31 on shutter 1 projects through the base portion 3 by means of opening 32 which is designed to facilitate its motion. Raised portion of shutter 1 leading to extension 31 is provided for in raised section 33 which is a portion of cover 21. Also included in cover 21 is channel 20 which provides external entry to the mechanism included in the self-locking coin receptacle cover of the present invention when cover 21 is secured over the shutter and draw bar mechanism and associated parts and secured or positioned in place by means of rivets 23 through 28, inclusive.

Figure 3:
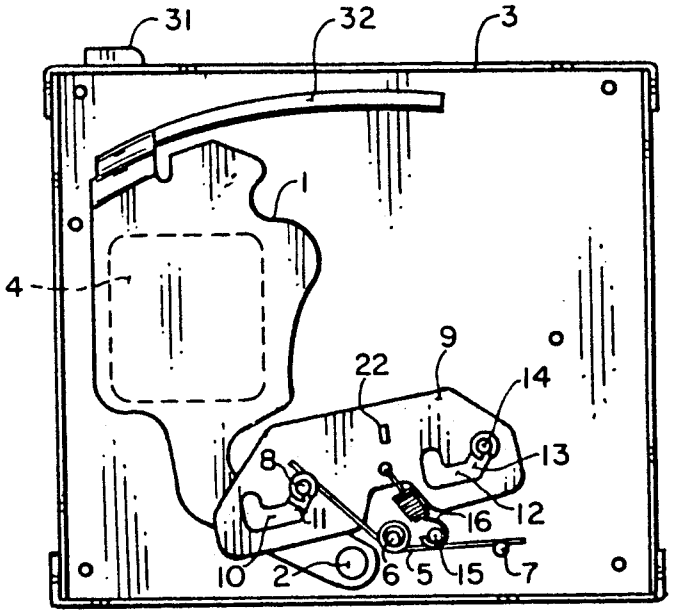
FIG. 3 is a partial top view of a self-locking coin receptacle cover showing the internal mechanism in its released position.
Figure 2:
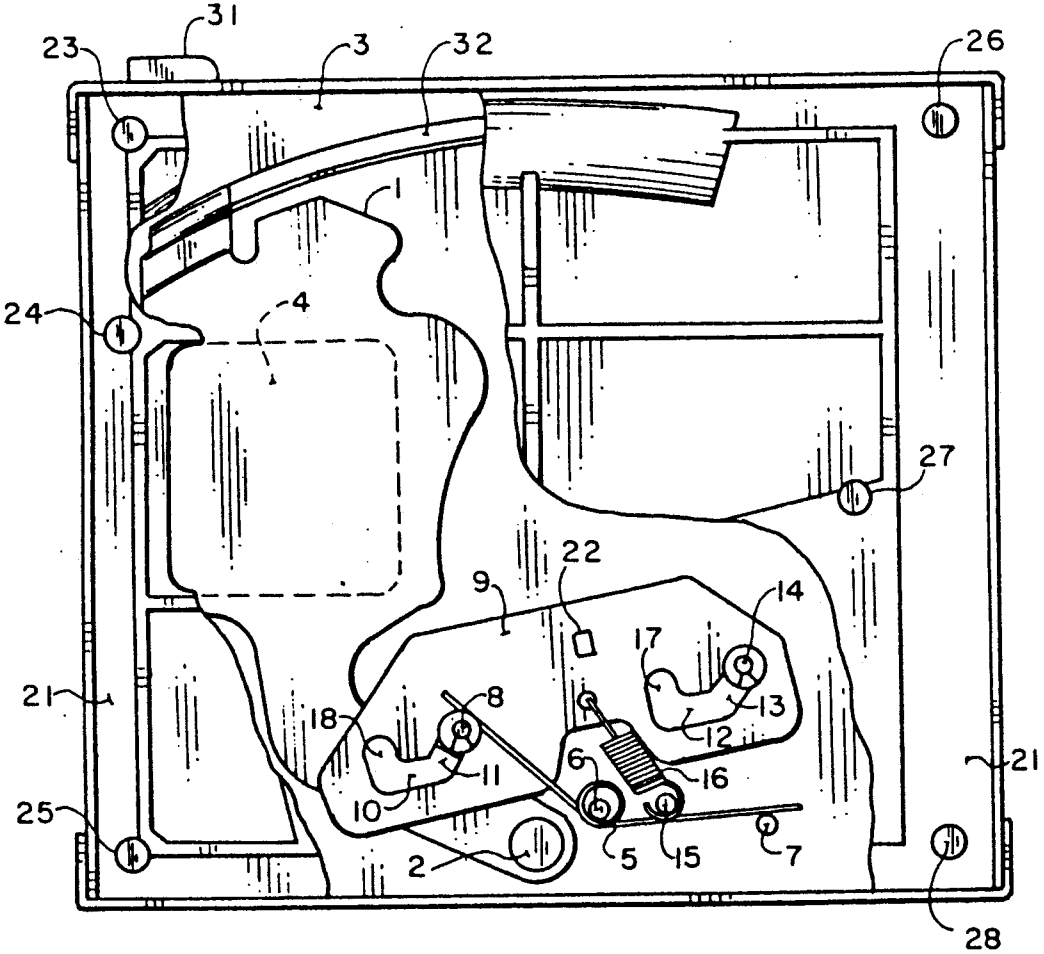
FIG. 2 is a partially broken away top view of a self-locking coin receptacle cover in accordance with the present invention.
Figure 5:
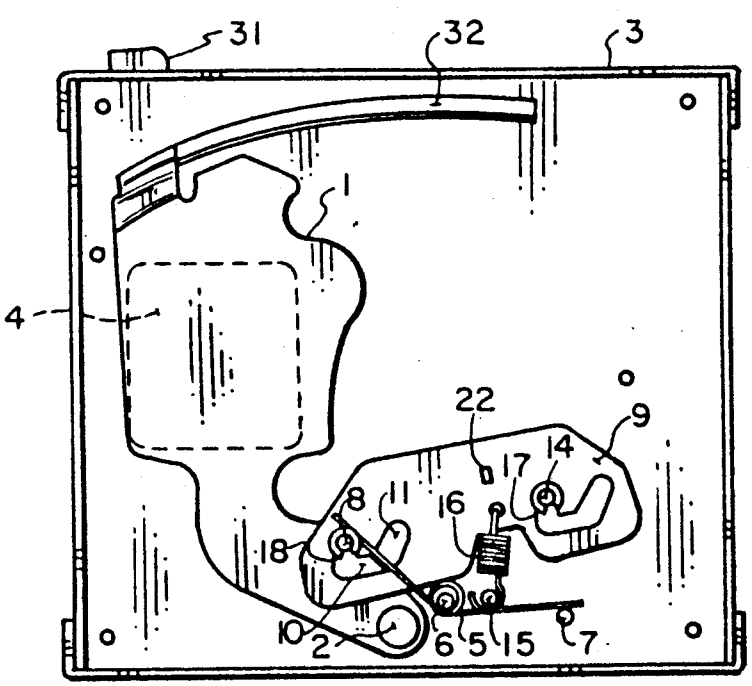
FIG. 5 is a partial top view of a self-locking coin receptacle cover in accordance with the present invention showing the internal mechanism thereof in the locked position.
Figure 4:
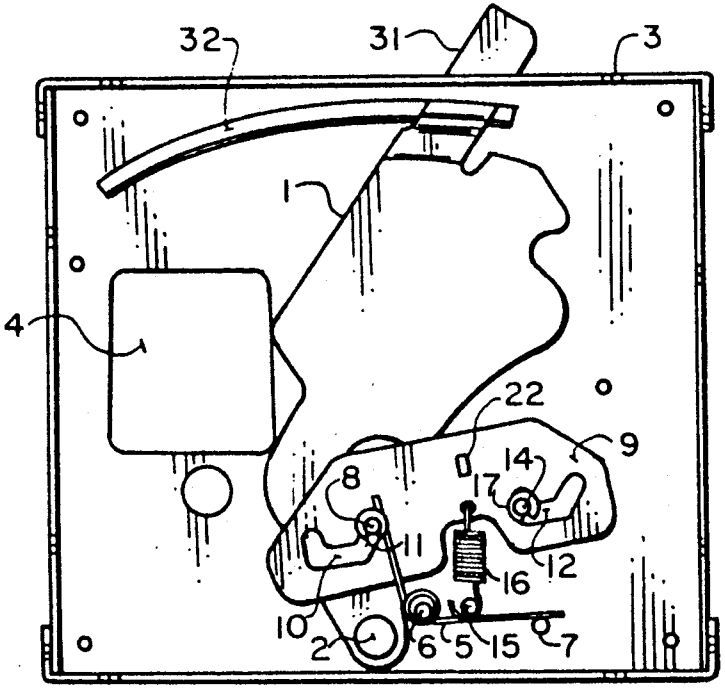
FIG. 4 is a partial view of a self-locking coin receptacle cover in accordance with the present invention showing the internal mechanism in the activated or set position.

Referring now to FIGS. 2 and 3, shutter 1 which is adapted to rotate about pin 2 which is riveted to cover 3 permits opening and closing of the coin receptacle opening 4. As seen in FIGS. 2 and 3, the shutter 1 is biased to the closed position by torsion spring 5 which is mounted to pins 6 and 7 and bears on shutter pin 8. Upon rotation, pin 8 which is riveted to shutter 1, pushes draw bar 9 by engaging leg 11 of slot 10 in draw bar 9. Draw bar slot 12 starting at leg 13 in conjunction with draw bar pin 14 which is riveted to cover 3 guides the draw bar. The draw bar 9 is biased toward extension spring mounting pin 15 which is also riveted to cover 3 with the biasing of draw bar 9 being in response to extension spring 16. When the shutter 1 is fully open, pin 14 moves into draw bar slot 12 as may be seen in FIG. 4. This action will prevent the draw bar 9 from returning to its original set position when shutter 1 returns to its home position. It does, however, permit a slight rotation of draw bar 9. This open position of the receptacle cover is so positioned as to permit coins from the coin chute mechanism of the coin telephone into the paystation vault or receptacle. When the receptacle is removed, shutter 1 returns to the home position and pin 8 moves the along draw bar slot 10 starting at leg 11 but ending up in leg 18. With the shutter in the home position, draw bar 9 rotates, engaging leg 18 as shown in FIG. 5. In this position shutter 1 remains in the locked position.

To reset the internal mechanism of the self-locking receptacle cover of the present invention, a small screw driver or similar tool is inserted through channel 20 of cover 21 as seen in FIG. 1 and is inserted into opening 22 of draw bar 9. The screwdriver is then moved along channel 20. This motion effectively causes return to the set position. By this action, draw bar is raised out of the locked position. As seen in FIG. 5 pins 8 and 14 in legs 18 and 17, respectively, are moved over and down into the set position with pins 8 and 14 returning to slot legs 11 and 13, respectively, as may be seen in FIG. 3 as well as in FIG. 2.

While but a single embodiment of the present invention has been shown it will be obvious to those skilled in the art that numerous modifications may be made without departing from the spirit of the present invention which shall be limited only by the scope of the claims appended hereto.

What is claimed is:

1. A self-locking coin receptacle cover for use with a coin receptacle mounted in a telephone paystation, said cover comprising:

a base including an opening adapted to facilitate the passage of coins deposited in said paystation into said coin receptacle;

a rotatable shutter fastened to said base and normally positioned over said opening;

a draw bar located in a first position and movably secured to said base and to said shutter;

said draw bar further including an opening facilitating the engagement of means manually operated to move said draw bar to lock said shutter in the normally closed position;

an extension on said shutter adapted to engage a portion of said paystation, rotating said shutter to a position away from said opening and moving said draw bar to a second position;

said shutter further operated in response to removal of said receptacle from said paystation to rotate said shutter to a position over said opening and to move said draw bar to a third position, thereby locking said shutter in the closed position.

2. A self-locking coin receptacle cover as claimed in claim 1 wherein:

said draw bar includes a first slot engaged by a first pin secured to said shutter.

3. A self-locking coin receptacle cover as claimed in claim 2 wherein:

said draw bar includes a second slot engaging a second pin secured to said base.

4. A self-locking coin receptacle cover as claimed in claim 2 wherein:

said draw bar first slot includes first and second arms, said first pin engaging said first arm in said first position and engaging said second arm in said second position.

5. A self-locking coin receptacle cover as claimed in claim 3 wherein:

said draw bar second slot includes first and second arms, said second pin engaging said first arm in said first position and in said second position, and engaging said second arm in said third position.

6. A self-locking coin receptacle cover as claimed in claim 5 wherein:

said first pin is restored to said first leg in said first slot, and said second pin is restored to said second slot, second leg in response to movement of said shutter to said first position.

* * * * *